US006334976B1

(12) United States Patent
Anderson et al.

(10) Patent No.: US 6,334,976 B1
(45) Date of Patent: Jan. 1, 2002

(54) FLUID COOLED COHERENT JET LANCE

(75) Inventors: John Erling Anderson, Somers; William John Mahoney, Dobbs Ferry; Balu Sarma, Airmont, all of NY (US); Dennis Robert Farrenkopf, Bethel, CT (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/631,945

(22) Filed: Aug. 3, 2000

(51) Int. Cl.[7] ..... C21C 5/32
(52) U.S. Cl. ..... 266/225; 266/268
(58) Field of Search ..... 266/268, 225, 266/271, 272, 217

(56) References Cited

U.S. PATENT DOCUMENTS

| | | | | |
|---|---|---|---|---|
| 3,427,151 A | | 2/1969 | Koudelka et al. | 75/59 |
| 4,488,682 A | | 12/1984 | Kobayashi et al. | 239/132.3 |
| 4,622,007 A | | 11/1986 | Gitman | 432/13 |
| 5,714,113 A | | 2/1998 | Gitman et al. | 266/182 |
| 5,814,125 A | | 9/1998 | Anderson et al. | 75/414 |
| 5,823,762 A | | 10/1998 | Anderson et al. | 43/8 |
| 6,096,261 A | * | 8/2000 | Anderson et al. | 266/225 |

FOREIGN PATENT DOCUMENTS

| | | |
|---|---|---|
| EP | 866139 | 9/1998 |
| EP | 874194 | 10/1998 |

* cited by examiner

*Primary Examiner*—Scott Kastler
(74) *Attorney, Agent, or Firm*—Stanley Ktorides

(57) ABSTRACT

A lance which may be used to generate a longer coherent gas jet having inflowing and outflowing coolant fluid passages which are in flow communication and which straddle the flame envelope fluid passages, all of which are coaxial with the main passageway.

4 Claims, 2 Drawing Sheets

FLUID COOLED COHERENT JET LANCE

TECHNICAL FIELD

This invention relates generally to coherent jet technology.

BACKGROUND ART

A recent significant advancement in the field of gas lancing is the development of the coherent jet technology disclosed, for example, in U.S. Pat. No. 5,814,125—Anderson et al. In the practice of this technology, a high velocity gas jet ejected from a lance is maintained coherent over a relatively long distance by the use of a flame envelope around and coaxial with the high velocity gas jet. The flame envelope is generated by combusting respective streams of fuel and oxidant which are each annular to the ejected high velocity gas jet. The resulting coherent jet can be used to deliver gas into a liquid, such as molten metal, from a relatively long distance above the surface of the liquid. One very important application of this coherent jet technology has been for providing oxygen for use in an electric arc furnace.

It is desirable to employ coherent jet technology in other steelmaking operations such as basic oxygen furnaces. The potential for using coherent jet technology in a basic oxygen furnace and other large scale applications would be enhanced if the coherent jets were made longer.

Accordingly it is an object of this invention to provide a lance which may be used to provide a coherent gas jet which may be longer than comparable heretofore known coherent jets.

SUMMARY OF THE INVENTION

The above and other objects, which will become apparent to those skilled in the art upon a reading of this disclosure, are attained by the present invention which is:

A lance for providing at-least one coherent jet comprising:

(A) a main passageway communicating with at least one nozzle for providing main gas from the lance;

(B) a first annular passageway coaxial with and radially spaced from the main passageway for flow of cooling fluid;

(C) a second annular passageway coaxial with and radially spaced from the first annular passageway for flow of first flame envelope fluid;

(D) a third annular passageway coaxial with and radially spaced from the second annular passageway for flow of second flame envelope fluid;

(E) a fourth annular passageway coaxial with and radially spaced from the third annular passageway for flow of cooling fluid; and (F) at least one flow passage for flow of cooling fluid between the first annular passageway and the fourth annular passageway.

As used herein the term "coherent jet" means a gas jet which has a velocity profile for a considerable distance downstream of the nozzle from which it was ejected which is similar to the velocity profile which it has upon ejection from the nozzle.

As used herein the term "annular" means in the form of a ring.

As used herein the term "flame envelope" means an annular combusting stream coaxial with the main gas stream.

As used herein the term "length" when referring to a coherent gas jet means the distance from the nozzle from which the gas is ejected to the intended impact point of the coherent gas jet or to where the gas jet ceases to be coherent.

As used herein the term "axis" means the imaginary line running longitudinally through the center of a lance.

Figure 1:
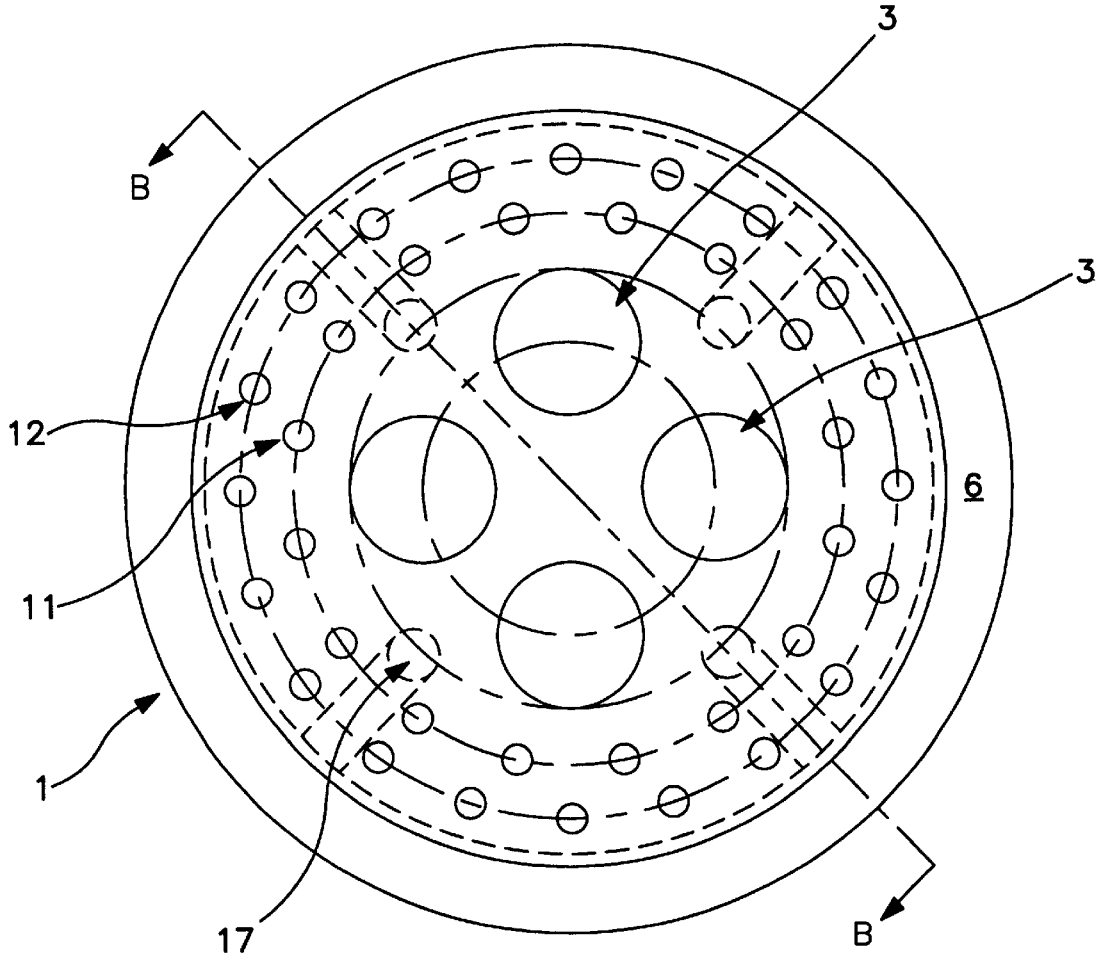
FIG. 1 is a head on view of one preferred embodiment of the fluid cooled coherent jet lance of this invention.

The numerals in the Drawings are the same for the common elements.

DETAILED DESCRIPTION

The invention embodies the discovery that, all other things being equal, the length of a coherent jet can be increased if the flame envelope around the main gas jet is provided somewhat radially spaced from the main gas jet. In the invention, cooling fluid is passed in an annular passageway immediately adjacent the main passageway wherein flows the main gas which forms the coherent jet. This has the effect of radially spacing the annular passageways which deliver flame envelope fluid further from the main passageway than in conventional practice. The other cooling fluid passageway is on the other side of the two flame envelope fluid passageways. In this way the flame envelope fluids are ejected from the lance at a further than conventional distance from the perimeter of the coherent jet(s) so as to enable coherent jet(s) of increased length, but not so large a distance as to have a detrimental effect on the efficacy of the flame envelope in establishing and maintaining the coherent jet(s).

Figure 2:
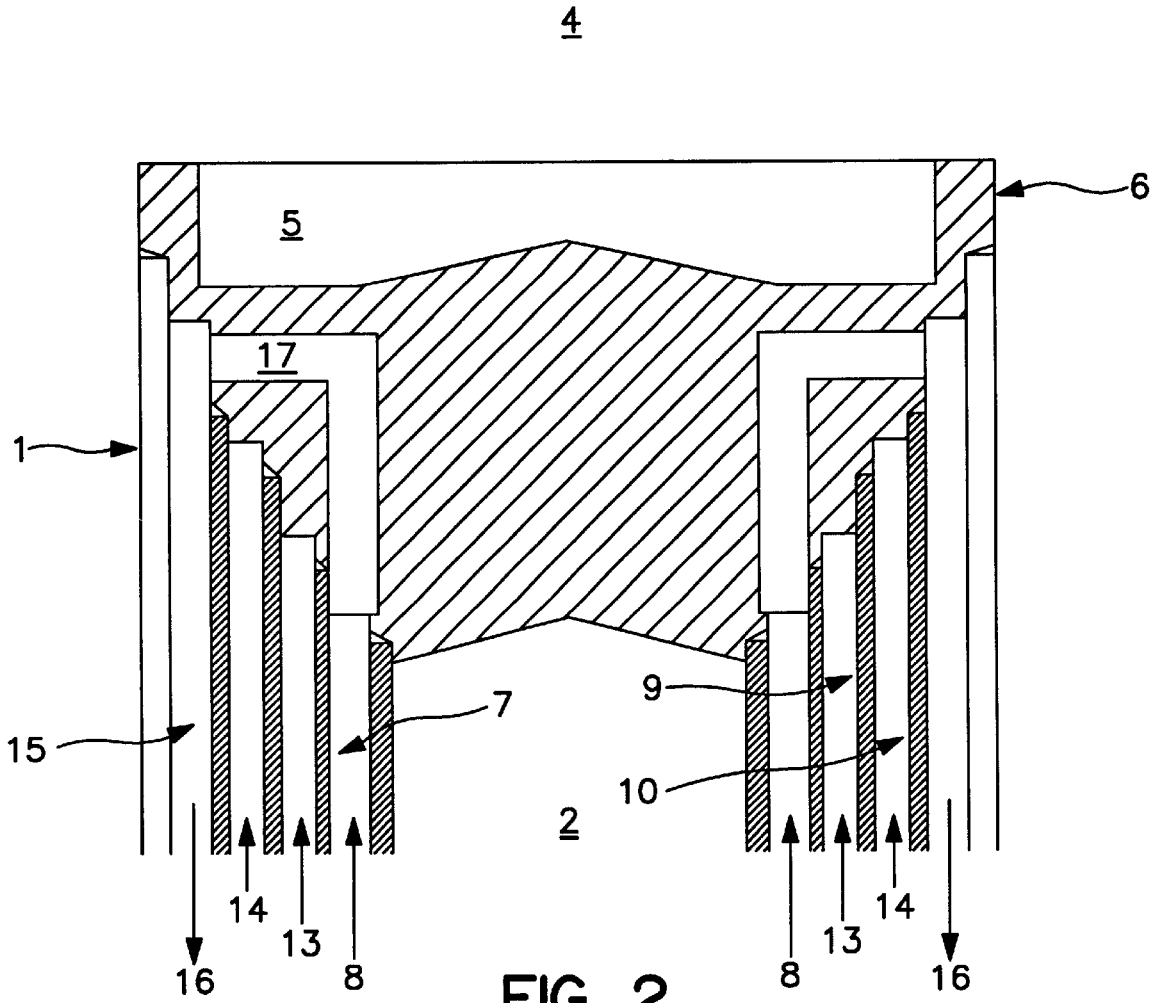
FIG. 2 is a cross sectional view of the lance illustrated in FIG. 1 taken along B—B.

The invention will be described in greater detail with reference to the Drawings. Referring now to FIGS. 1 and 2, coherent jet lance 1 comprises a main passageway 2 which communicates with nozzles 3. Main passageway 2 communicates with a source of main gas (not shown). The main gas may be any gas or gas mixture. Examples of main gas include oxygen, nitrogen, argon, and air. The main gas passes through the main passageway and is ejected out from the lance through the nozzles into injection space 4, such as, for example the interior of a steelmaking furnace. As is seen from the FIG. 1, the embodiment of the invention illustrated in the Drawings employs four nozzles for the ejection of main gas from lance 1. Also, as shown in FIG. 2, the main gas, as well as the flame envelope fluids which will be described below, are provided first into protective zone 5 formed by lance extension 6 before passing into injection space 4. Preferably, as shown in FIG. 2, protective zone 5 has a greater depth at its periphery and has its shortest depth at its midpoint coinciding with the lance axis.

First annular passageway 7 is coaxial with and radially spaced from main passageway 2. Cooling fluid, such as water, flows through first annular passageway 7. Preferably, as shown in FIG. 2 by flow arrow 8, cooling fluid flows through first annular passageway 7 toward the head or face of lance 1 although, if desired this flow direction of cooling fluid could be reversed.

Second annular passageway 9 is coaxial with and radially spaced from first annular passageway 7 and communicates with inner annular injection means such as circle of holes 11. Third annular passageway 10 is coaxial with and radially spaced from second annular passageway 9 and communicates with outer annular injection means such as circle of holes 12. Flame envelope fluid, either fuel or oxidant, passes through passageways 9 and 10 and is injected through the respective circle of holes 11 and 12 into protective zone 5 and then into injection space 4 where they combust to form the flame envelope around the main gas jet. In a preferred embodiment fuel, such as natural gas, is the first flame envelope fluid 13 flowing in passageway 9, an oxidant is the second flame envelope fluid 14 flowing in passageway 10. The oxidant may be any effective oxidant such as air, oxygen-enriched air or pure oxygen. The sources of the first and second flame envelope fluids are not shown in the Drawings. If desired, the oxidant for the flame envelope may flow in inner flame envelope passageway 9, and the fuel for the flame envelope may flow in outer flame envelope passageway 10.

Fourth annular passageway 15 is coaxial with and radially spaced from third annular passageway 10. Cooling fluid flows through passageway 15. Preferably, as shown by flow arrow 16 in FIG. 2, cooling fluid flows in passageway 15 away from the head or face of lance 1.

First annular passageway 7 and fourth annular passageway 15 communicate by means of one or more flow passages 17. In the embodiment illustrated in the Drawings, cooling fluid flows from first annular passageway 7 through flow passages 17 into fourth annular passageway 15. Preferably, as shown in FIG. 2, passageway(s) 17 is in part parallel to and in part perpendicular to the axis of lance 1, although passageway(s) 17 could also be at an acute angle to the axis of lance 1. It is of course understood that the first and fourth annular passageways differ from the second and third annular passageways in that there is no means by which fluid flowing in the first and fourth annular passageways may pass out from the lance at the head or face of the lance into the injection space. That is, annular passageways 7 and 15 are closed to the head or face of lance 1.

The invention enables effective cooling of the lance, which is particularly important if the lance is employed in a hot environment such as a steelmaking furnace, while also synergistically orienting the flame envelope delivery passages at a greater distance from the main passageway, ultimately resulting in the generation of a longer coherent gas jet which may be advantageously employed in a large scale operation such as a basic oxygen furnace.

Although the invention has been described in detail with reference to a certain preferred embodiment, those skilled in the art will recognize that there are other embodiments of the invention within the spirit and the scope of the claims.

We claim:

1. A lance for providing at least one coherent jet comprising:

(A) a main passageway communicating with at least one nozzle for providing main gas from the lance;

(B) a first annular passageway coaxial with and radially spaced from the main passageway for flow of cooling fluid;

(C) a second annular passageway coaxial with and radially spaced from the first annular passageway for flow of first flame envelope fluid;

(D) a third annular passageway coaxial with and radially spaced from the second annular passageway for flow of second flame envelope fluid;

(E) a fourth annular passageway coaxial with and radially spaced from the third annular passageway for flow of cooling fluid, and wherein the first and fourth annular passageways straddle the second and third annular passageways; and (F) at least one flow passage for flow of cooling fluid between the first annular passageway and the fourth annular passageway.

2. The lance of claim 1 having a plurality of nozzles.

3. The lance of claim 1 having an extension forming a protective zone with which said at least one nozzle communicates.

4. The lance of claim 1 wherein said at least one flow passage for flow of cooling fluid between the first annular passageway and the fourth annular passageway is in part parallel to and in part perpendicular to the axis of the lance.

* * * * *